US010471704B2

(12) United States Patent
Füllgraf et al.

(10) Patent No.: US 10,471,704 B2
(45) Date of Patent: Nov. 12, 2019

(54) PRINTING SLEEVE AND METHOD FOR PRODUCING A PRINTING SLEEVE

(71) Applicant: ContiTech Elastomer-Beschichtungen GmbH, Hannover (DE)

(72) Inventors: Stefan Füllgraf, Duderstadt (DE); Armin Senne, Ettenheim (DE); Jens Löschner, Bovenden (DE); Torsten Raschdorf, Einbeck (DE)

(73) Assignee: ContiTech Elastomer-Beschichtungen GmbH, Hannover (DE)

( * ) Notice: Subject to any disclaimer, the term of this patent is extended or adjusted under 35 U.S.C. 154(b) by 70 days.

(21) Appl. No.: 15/517,541

(22) PCT Filed: Jul. 6, 2015

(86) PCT No.: PCT/EP2015/065275

§ 371 (c)(1),
(2) Date: Apr. 7, 2017

(87) PCT Pub. No.: WO2016/058714

PCT Pub. Date: Apr. 21, 2016

(65) Prior Publication Data

US 2017/0239935 A1 Aug. 24, 2017

(30) Foreign Application Priority Data

Oct. 15, 2014 (DE) ..... 10 2014 220 850

(51) Int. Cl.

| | |
|---|---|
| ***B41C 1/18*** | (2006.01) |
| ***B41F 5/24*** | (2006.01) |
| ***B41N 1/22*** | (2006.01) |

(52) U.S. Cl.
CPC ..... *B41C 1/182* (2013.01); *B41C 1/186* (2013.01); *B41F 5/24* (2013.01); *B41N 1/22* (2013.01)

(58) Field of Classification Search
CPC ..... B41C 1/182
USPC ..... 101/376
See application file for complete search history.

(56) References Cited

U.S. PATENT DOCUMENTS

| | | | | |
|---|---|---|---|---|
| 3,982,312 A * | 9/1976 | Finzer | B41F 31/26 492/56 |
| 4,144,813 A | 3/1979 | Julian et al. | |
| 4,378,622 A * | 4/1983 | Pinkston | B41N 7/06 101/376 |
| 4,702,946 A | 10/1987 | Howland | |

(Continued)

FOREIGN PATENT DOCUMENTS

| | | |
|---|---|---|
| EP | 766142 A1 | 4/1997 |
| JP | H11254845 A | 9/1999 |

*Primary Examiner* — Anthony H Nguyen
(74) *Attorney, Agent, or Firm* — David L. Cate

(57) ABSTRACT

A printing sleeve includes a first and radially inward layer having an inner side for directly contacting the outer side of a printing cylinder, and an outer side which is radially opposite the inner side. The first and radially inward layer has a glass fiber reinforced compressible compound such that the glass fibers may absorb the forces that arise in the circumferential direction and/or in the longitudinal direction, and the compressible compound elements may absorb the pressures that arise in the radial direction. In this way, the materials which to date act separately in the base sleeve and the compressible layer are combined in one common layer in which said materials each may perform their function.

4 Claims, 1 Drawing Sheet

(56) References Cited

U.S. PATENT DOCUMENTS

| | | | | | |
|---|---|---|---|---|---|
| 5,216,954 | A * | 6/1993 | Thompson | B41F 27/105 | 101/375 |
| 5,752,444 | A | 5/1998 | Lorig | | |
| 5,798,019 | A | 8/1998 | Cushner et al. | | |
| 5,819,657 | A * | 10/1998 | Rossini | B41F 13/10 | 101/376 |
| 5,860,360 | A * | 1/1999 | Lane, III | B32B 27/12 | 101/376 |
| 6,703,095 | B2 * | 3/2004 | Busshoff | B29C 63/20 | 101/217 |
| 2002/0014169 | A1 * | 2/2002 | Siler | B41F 5/24 | 101/138 |
| 2002/0046668 | A1 * | 4/2002 | Bell | B41F 13/10 | 101/376 |
| 2005/0241502 | A1 | 11/2005 | Hoffman et al. | | |
| 2009/0158948 | A1 | 6/2009 | Shuman | | |
| 2011/0089609 | A1 | 4/2011 | Landry-Coltrain et al. | | |
| 2011/0303110 | A1 * | 12/2011 | Grassler | B41C 1/05 | 101/382.1 |
| 2014/0345482 | A1 | 11/2014 | Fuellgraf et al. | | |
| 2015/0135978 | A1 * | 5/2015 | Klitza | B41N 6/00 | 101/368 |

* cited by examiner

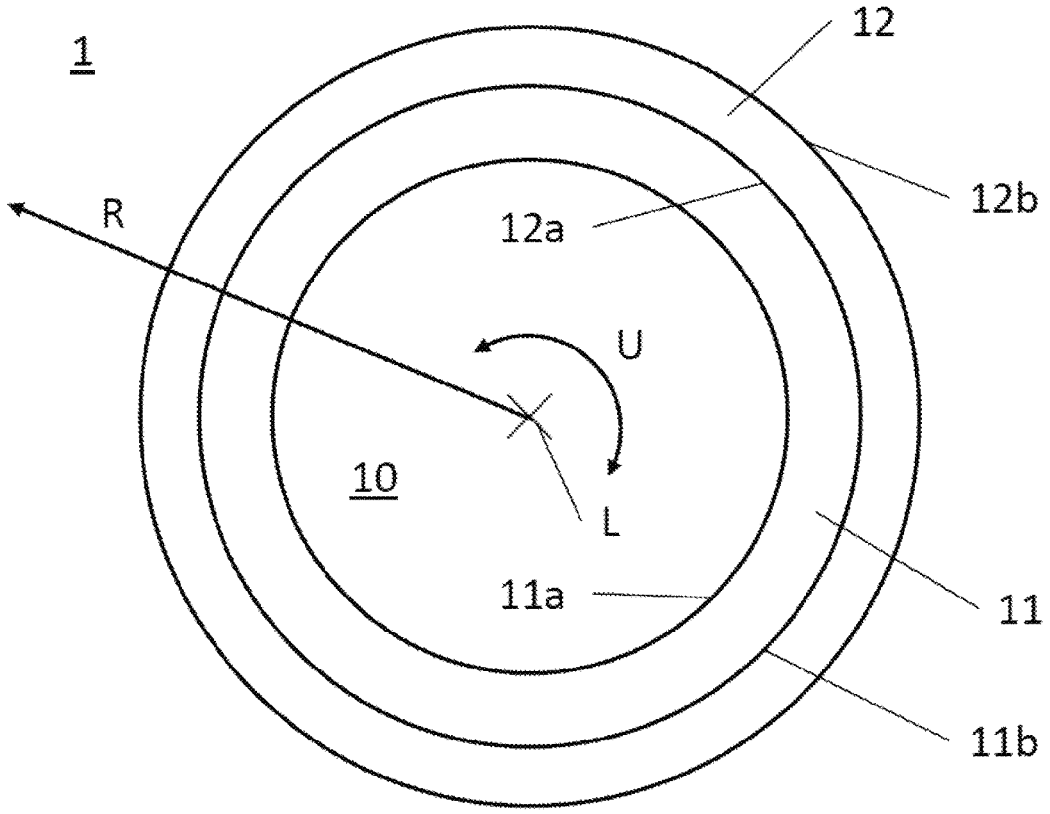
1
12
12b
R
12a
U
10
L
11a
11
11b

PRINTING SLEEVE AND METHOD FOR PRODUCING A PRINTING SLEEVE

In flexo printing, (printing) sleeves having a dimensionally stable reinforcement member, the so-called base sleeve, are employed as printing plates, the printing surface thereof that is directed outward being composed of an elastomer material or having such a material, respectively, that is to say being rubber-coated. These printing plates are used on printing cylinders onto which the former are push-fitted while being radially expanded. To this end, the dimensionally stable printing sleeves that are difficult to radially expand are expanded from the inside by compressed air; to this end, said printing sleeves have to be air tight. This radial elongation or expansion enables push-fitting onto the printing cylinder. Once the compressed air is switched off, the printing sleeve contracts back to its initial state, that is to say reassumes its actual diameter. On account thereof, a firm fit of the printing sleeve on the printing cylinder is achieved, the external diameter of the latter being at least slightly larger than the internal diameter of the base sleeve of the printing sleeve in the contracted state, that is to say in the non-expanded state.

A printing sleeve is usually constructed in three layers, specifically from the inside to the outside having a base sleeve as a reinforcement member, a compressible layer, and a cover layer which may act as a printing layer; herein, any potential bonding agents between these layers are not considered as layers.

GRP materials (glass fiber reinforced plastics materials) are presently used as the base sleeve. The base sleeve serves for absorbing torsion forces. The kinetic friction value which acts while push-fitting onto the printing cylinder may be set or influenced, respectively, by the design of the base sleeve, in particular of the inner side of the base sleeve.

Elastomer sheets or compounds which may either be compressible or non-compressible are then applied onto a base sleeve of this type. This compressible layer serves for absorbing compression forces, for reducing vibrations, and for improving the surface print. The compressible layer establishes the connection between the base sleeve and the cover layer.

The cover layer is engravable, for example laser-engravable, so as to be able to depict the object to be printed on this printing layer. Said cover layer is intended to guarantee a positive transfer of ink and to have as little bulking as possible. All these layers are made in a seamless manner so as to avoid a depiction of such a seam in the printed image.

A triple-layered or triple-tiered printing sleeve of this type, is presently produced as follows, for example:

- The base sleeve is generated in a first operative step in that a non-woven, for example, is soaked with epoxy resin, for example, is wound around a cylinder, and thereafter is cured by a heating procedure at a corresponding pressure. The fully dried base sleeve in a further step is then usually ground.
- The compressible or non-compressible layer is then applied onto the finished base sleeve as a rubber-sheet blank, for example, heated and subsequently ground. The use of a bonding agent between these two layers for enabling or reinforcing mutual bonding therebetween, respectively, is also usual practice.
- The elastomer cover layer as a printing layer is then applied onto the compressible or non-compressible layer, respectively.

U.S. Pat. No. 6,703,095 B2 relates to a printing sleeve for a printing cylinder, having a triple-layered construction, and to a production method for generating a sleeve of this type.

In the case of the usual printing sleeves, or in the case of the production of the latter, respectively, it is disadvantageous that said printing sleeves have various layers which each substantially assume one function in the case of the finished printing sleeve, and that correspondingly many different production steps are also required for the various layers. This leads to effort and costs.

It is therefore an object of the present invention to provide a printing sleeve of the type described at the outset, which with the same or better functionality is constructed in a simpler and/or a more cost-effective manner, and/or which may be produced in a simpler, more cost-effective and/or faster manner. In particular, the number of operative steps for producing a printing sleeve of this type, and the costs created on account thereof, are to be reduced.

The object is achieved according to the invention by a printing sleeve having the features according to the independent claim. Advantageous developments are described in the dependent claims.

The invention thus relates to a printing sleeve according to the preamble of the independent. This printing sleeve is characterized in that the outer side of the first and radially inward layer and the inner side of the second and radially outward layer bear directly on one another, and in that the first and radially inward layer is configured to be able to absorb both forces that arise in the circumferential direction and/or in the longitudinal direction as well as pressures that arise in the radial direction.

In this way, the properties or functions, respectively, which in the case of known printing sleeves to date have been separately apportioned to the base sleeve and to the compressible layer may be assumed by one common layer. On account thereof, the construction and the production of a printing sleeve according to the invention is simplified and rendered more cost-effective by reducing the number of layers from previously three to now only two layers. The thickness of the printing sleeve in the radial direction may also be reduced.

According to one aspect of the present invention, the first and radially inward layer has a (glass) fiber reinforced compressible compound such that the (glass) fibers may absorb the forces that arise in the circumferential direction and/or in the longitudinal direction, and the compressible compound elements may absorb the pressures that arise in the radial direction. In this way, the materials which to date act separately in the base sleeve and the compressible layer are combined in one common layer in which said materials each may perform their function. Said materials thus compensate for the disadvantages or weaknesses, respectively, of the respective other material such that according to the invention the functions of the base sleeve and of the compressible layer may be utilized in one common layer.

According to a further aspect of the present invention, the first and radially inward layer has a non-woven and/or an open-pore woven fabric and/or a mesh structure which have/has a compressible rubber compound such that the non-woven and/or the open-pore woven fabric and/or the mesh structure may absorb the forces that arise in the circumferential direction and/or in the longitudinal direction, and the compressible rubber compound may absorb the pressures that arise in the radial direction. Materials or layers, respectively, that to date have been separated are also combined in one common layer in this variant of embodiment.

The present invention also comprises that the first and inner layer may be a non-compressible layer which may be produced in a manner that in principle is identical to that previously described, but is provided with a non-compressible rubber compound instead of a compressible rubber compound. In this way, a non-compressible printing sleeve having two layers may also be produced.

It is advantageous in all cases that the rubber compound of the compressible or non-compressible, respectively, first and inner layer may be able to perform better linking to the printing layer than is the case in usual base sleeves or compressible layers, respectively, because the printing layer also has an elastomer material and two rubber compounds are in direct mutual contact.

The present invention also relates to a method for producing a printing sleeve as has been described above, said method comprising the following steps:

applying a first (glass) fiber reinforced compressible compound onto a cylinder, molding the first compound on the cylinder, so as to form a first and radially inward layer which may absorb both forces that arise in the circumferential direction and/or in the longitudinal direction (L) as well as pressures that arise in the radial direction, applying a second compound to the outer side of the first and radially inward layer, and molding the second compound on the outer side of the first and radially inward layer, so as to form a second and radially outward layer, the outer side thereof being configured as a printing surface.

A printing sleeve according to the invention which has the advantages described above may be produced by means of a method of this type. Both the first as well as the second compound are preferably an elastomer compound, that is to say a rubber compound.

According to a further aspect of the present invention, the application of the first (glass) fiber reinforced compressible compound onto the cylinder is performed by means of a calendering process such that the fibers are oriented by way of the calendering process. The implementation of this production step by means of a calender is advantageous because a respective orientation of the fibers in the material may be achieved in a simple manner such that said fibers in the finished printing sleeve may absorb forces that arise in the circumferential direction and/or in the longitudinal direction.

The present invention also relates to a method comprising the following steps:

applying a non-woven and/or an open-pore woven fabric and/or a mesh structure onto a cylinder, incorporating a compressible rubber compound into the non-woven and/or into the open-pore woven fabric and/or into the mesh structure, so as to configure a first and radially inward layer which may absorb both forces that arise in the circumferential direction and/or in the longitudinal direction as well as pressures that arise in the radial direction, applying a second compound to the outer side of the first and radially inward layer, and molding the second compound on the outer side of the first and radially inward layer, so as to form a second and radially outward layer, the outer side thereof being configured as a printing surface.

A printing sleeve according to the invention which has the advantages described above may also be produced by means of a method of this type. Both the first as well as the second compound are preferably an elastomer compound, that is to say a rubber compound.

An exemplary embodiment and further advantages of the invention will be explained hereunder in conjunction with the following FIGURES. The FIGURE shows a schematic sectional illustration of a printing sleeve according to the invention.

The FIGURE shows a schematic sectional illustration of a printing sleeve 1 according to the invention. This illustration shows a cross section through a printing sleeve 1 which extends in a cylindrical manner in the direction of the longitudinal axis L thereof. The printing sleeve 1 has a first and radially inward layer 11 which in the circumferential direction U is configured so as to be seamlessly closed.

The printing sleeve 1 by way of the first and radially inward layer 11 thereof is fitted onto a printing cylinder 10. To this end, said printing sleeve 1 has been radially expanded from the inside, using compressed air. Herein, the printing sleeve 1 by way of the inner surface 11*a* of the first and radially inward layer 11 bears in a force-fitting manner on the outer surface of the printing cylinder 10. The printing sleeve 1 furthermore has a second and radially outward layer 12 which by way of the inner surface 12*a* thereof directly bears on the outer surface 11*b* of the first and radially inward layer 11. The outer surface 12*b* of the second and radially outward layer 12 is configured as a printing surface.

The first and radially inward layer 11 is configured for example as a fiber reinforced compressible compound or as a non-woven reinforced compressible compound in such a manner that said layer 11 may assume both the function of a conventional base sleeve as well as simultaneously that of a compressible layer. In this way, the functions and the function modes of these two layers are combined according to the invention in one common layer, which in relation to known printing sleeves simplifies and reduces the cost of the construction of the printing sleeve according to the invention.

LIST OF REFERENCE SIGNS

Part of the Description

L Longitudinal direction

R Radial direction, radius, perpendicular to the longitudinal direction L

U Circumferential direction

1 Printing sleeve, sleeve

10 Printing cylinder

11 First and radially inward layer or tier of the printing sleeve 1, respectively

11*a* Inner surface or inner side of the first and inward layer 11, respectively

11*b* Outer surface or outer side of the first and inward layer 11, respectively

12 Second and radially outward layer or tier of the printing sleeve 1, respectively

12*a* Inner surface or inner side of the second and outer layer 11, respectively

12*b* Outer surface or outer side of the second and outer layer 11, respectively

The invention claimed is:

1. A printing sleeve comprising:

a first and radially inward layer comprising an inner side for directly contacting the outer side of a printing cylinder, and an outer side which is radially opposite the inner side; and, a second and radially outward layer comprising an outer side for configuring a printing surface, and an inner side which is radially opposite the outer side;

wherein the outer side of the first and radially inward layer and the inner side of the second and radially outward layer bear directly on one another, and wherein the first and radially inward layer is configured to be able to absorb both forces that arise in the circumferential direction (U) and/or in the longitudinal direction (L), as well as pressures that arise in the radial direction (R);

wherein the first and radially inward layer has a glass fiber reinforced compressible compound such that glass fibers absorb the forces that arise in the circumferential direction (U) and/or in the longitudinal direction, and wherein the glass fiber compressible compound absorbs pressures that arise in the radial direction (R); and, wherein the first and radially inward layer is a glass fiber reinforced compressible elastomer compound and the second and radially outward layer comprises a rubber compound which is in direct mutual contact with the glass fiber reinforced compressible elastomer compound.

2. The printing sleeve as claimed in claim 1, wherein the first and radially inward layer has one or more of a non-woven, an open-pore woven fabric, or a mesh structure, and which comprises a compressible rubber compound such that the structure absorbs the forces that arise in the circumferential direction (U), and the compressible rubber compound absorbs the pressures that arise in the radial direction (R).

3. The printing sleeve as claimed in claim 1, wherein the first and radially inward layer has one or more of a non-woven, an open-pore woven fabric, or a mesh structure, and which comprises a compressible rubber compound such that the structure absorbs the forces that arise in the longitudinal direction (L), and the compressible rubber compound absorbs the pressures that arise in the radial direction (R).

4. The printing sleeve as claimed in claim 1, wherein the first and radially inward layer has one or more of a non-woven, an open-pore woven fabric, or a mesh structure, and which comprises a compressible rubber compound such that the structure absorbs the forces that arise in the circumferential direction (U) and in the longitudinal direction (L), and the compressible rubber compound absorbs the pressures that arise in the radial direction (R).

* * * * *